US006579072B2

(12) United States Patent
Trousil et al.

(10) Patent No.: US 6,579,072 B2
(45) Date of Patent: Jun. 17, 2003

(54) SWASH PLATE PUMP WITH LOW STRESS HOUSING

(75) Inventors: Dana Trousil, Delta (CA); Jan Kuyper, Vancouver (CA)

(73) Assignee: Teleflex Canada Limited Partnership, Richmond (CA)

( * ) Notice: Subject to any disclaimer, the term of this patent is extended or adjusted under 35 U.S.C. 154(b) by 0 days.

(21) Appl. No.: 09/916,199

(22) Filed: Jul. 27, 2001

(65) Prior Publication Data

US 2003/0021702 A1 Jan. 30, 2003

(51) Int. Cl.[7] ..... F04B 1/12; F04B 27/08
(52) U.S. Cl. ..... 417/269; 91/499; 92/57
(58) Field of Search ..... 60/475, 476, 473, 60/474; 92/57; 91/499, 501, 503, 507, 485, 486, 487, 421; 417/269

(56) References Cited

U.S. PATENT DOCUMENTS

| | | | | | |
|---|---|---|---|---|---|
| 3,636,820 | A | | 1/1972 | Lambeth | |
| 4,092,905 | A | * | 6/1978 | Wood | 91/499 |
| 4,211,148 | A | | 7/1980 | Boss | |
| 4,642,032 | A | | 2/1987 | McBeth | |
| 4,669,494 | A | | 6/1987 | McBeth | |
| 4,898,077 | A | | 2/1990 | McBeth | |
| 5,081,908 | A | * | 1/1992 | McBeth et al. | 91/499 |
| 5,212,995 | A | * | 5/1993 | Robinson et al. | 74/44 |
| 5,349,818 | A | | 9/1994 | McFadyen et al. | |
| 5,466,130 | A | * | 11/1995 | Kobelt | 417/269 |
| 5,481,871 | A | * | 1/1996 | McFadyen | 60/385 |
| 5,509,668 | A | * | 4/1996 | Kurita et al. | 277/81 |
| 5,601,504 | A | * | 2/1997 | Rocca et al. | 474/91 |
| 5,655,430 | A | * | 8/1997 | Richards | 92/57 |
| 6,055,809 | A | * | 5/2000 | Kishi et al. | 60/475 |

FOREIGN PATENT DOCUMENTS

| | | |
|---|---|---|
| EP | 0175206 | 3/1986 |
| GB | 2326677 | 12/1998 |

* cited by examiner

*Primary Examiner*—Charles G. Freay
*Assistant Examiner*—Han Lieh Liu
(74) *Attorney, Agent, or Firm*—Norman M. Cameron

(57) ABSTRACT

A rotary pump has a rotor with a first end, a second end opposite the first end, a central bore and a plurality of cylinder bores arranged about the central bore and extending completely through the rotor from the first end to the second end. There is a plurality of pistons, each piston being reciprocatingly received in one of the bores. A swash plate member has a swash plate adjacent the second end of the rotor and a spigot extending through the central bore of the rotor. There is in an end cap connected to the first end of the rotor. The end cap closes off the bores at the first end of the rotor. A drive shaft is rigidly connected to the end cap and extends away from the rotor. There is a cover having an aperture rotatably receiving the drive shaft. The cover extends about the end cap and the rotor and is connected to the swash plate member.

42 Claims, 8 Drawing Sheets

SWASH PLATE PUMP WITH LOW STRESS HOUSING

BACKGROUND OF THE INVENTION

This invention relates to swash plate pumps and, in particular, to swash plate pumps used for steering pumps on marine craft.

Swash plate pumps are conventionally used in marine steering systems. Such a pump is physically mounted to the helm and has a drive shaft which is rotated by the helm. When the helm is rotated, the pump forces hydraulic fluid to the stern of the boat where the pressurized fluid moves a steering cylinder connected to the rudder, or propulsion unit in the case of outboard motor drives or inboard/outboard drives.

Several designs of swash plate pumps have been utilized in the past for different classes of marine craft. These pumps typically have a swash plate mounted on a member with a spigot extending outwardly therefrom. A rotor is rotatably mounted about the spigot and has a plurality of cylinder bores. Pistons are reciprocatingly mounted within the cylinder bores. The ends of the cylinder bores opposite the swash plate are conventionally configured to seal the cylinder bores against high-pressure hydraulic fluid.

A number of different designs have been developed to isolate adjacent cylinder bores from each other with respect to the high-pressure hydraulic fluid. For example, in some prior art designs the rotors are closed on the end of each rotor opposite the swash plate by blind drilling the cylinder bores. This does provide effective sealing. However the rotors are difficult to machine accurately and accordingly are relatively expensive. Another known design utilizes a rotor with open-ended cylinders, but the cover of the pump must be strong enough to withstand high pressure from the hydraulic oil pressurized by the pump. Accordingly the cover has to be of thick plastic or metal and held in place by strong fasteners. This makes the cover relatively expensive to construct and assemble.

It is an object of the invention to provide an improved swash plate pump which has a rotor with open-ended bores forming the cylinders, but without requiring the cover of the pump to take high pressure or high stresses.

It is another object of the invention to provide an improved swash plate pump which is economical to produce and assemble.

It is a further object of the invention to provide an improved swash plate pump which is rugged in construction and reliable in operation.

SUMMARY OF THE INVENTION

According to an embodiment of the invention, there is provided a rotary pump having a rotor with a first end, a second end opposite the first end, a central bore and a plurality of cylinder bores arranged about the central bore and extending completely through the rotor from the first end to the second end. There is a plurality of pistons, each piston being reciprocatingly received in one of the bores. A swash plate member has a swash plate adjacent to the second end of the rotor. A spigot extends through the swash plate member and the central bore of the rotor. The rotor is rotatably supported on the spigot. There is in an end cap connected to the first end of the rotor. The end cap closes off the bores at the first end of the rotor. A drive shaft is rigidly connected to the end cap and extends away from the rotor.

There is a cover having an aperture rotatably receiving the drive shaft. The cover extends about the end cap and the rotor and is connected to the swash plate member.

Preferably, there is a bearing between the spigot and the rotor.

In one embodiment, the cover has a plurality of spaced-apart tabs and the swash plate member has a plurality of spaced-apart recesses. The tabs engage the recesses to connect the cover to the swash plate member.

Rotary pumps according to the invention offer significant advantages when compared with the prior art. They are easy to assemble and economical to produce, but provide reliable operation. This has been achieved in part by providing a rotor with cylinder bores which extend completely through the rotor. Such rotors are easier to machine and are more economical to produce than rotors having cylinder bores with one end closed by blind drilling. At the same time, the invention allows the use of relatively light weight and lightly stressed covers. This feature offers a more economical design and easier assembly compared with pumps having covers which must withstand relatively high hydraulic pressures. Furthermore, by using a special seal, the cover does not require a machined aperture to receive the drive shaft.

DETAILED DESCRIPTION OF THE PREFERRED EMBODIMENTS

Figure 1:
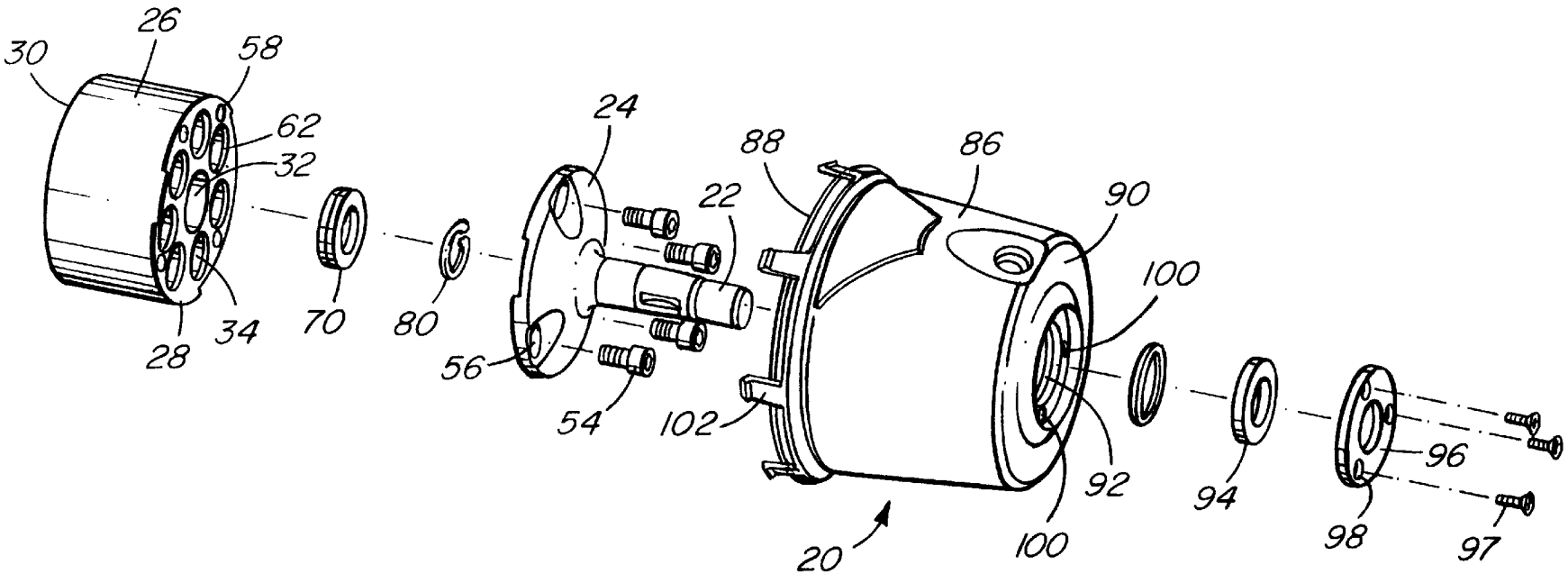
FIG. 1 is an exploded isometric view of a portion of a pump according to an embodiment of the invention, showing the rotor, end cap, drive shaft, cover and related components.
Figure 2:
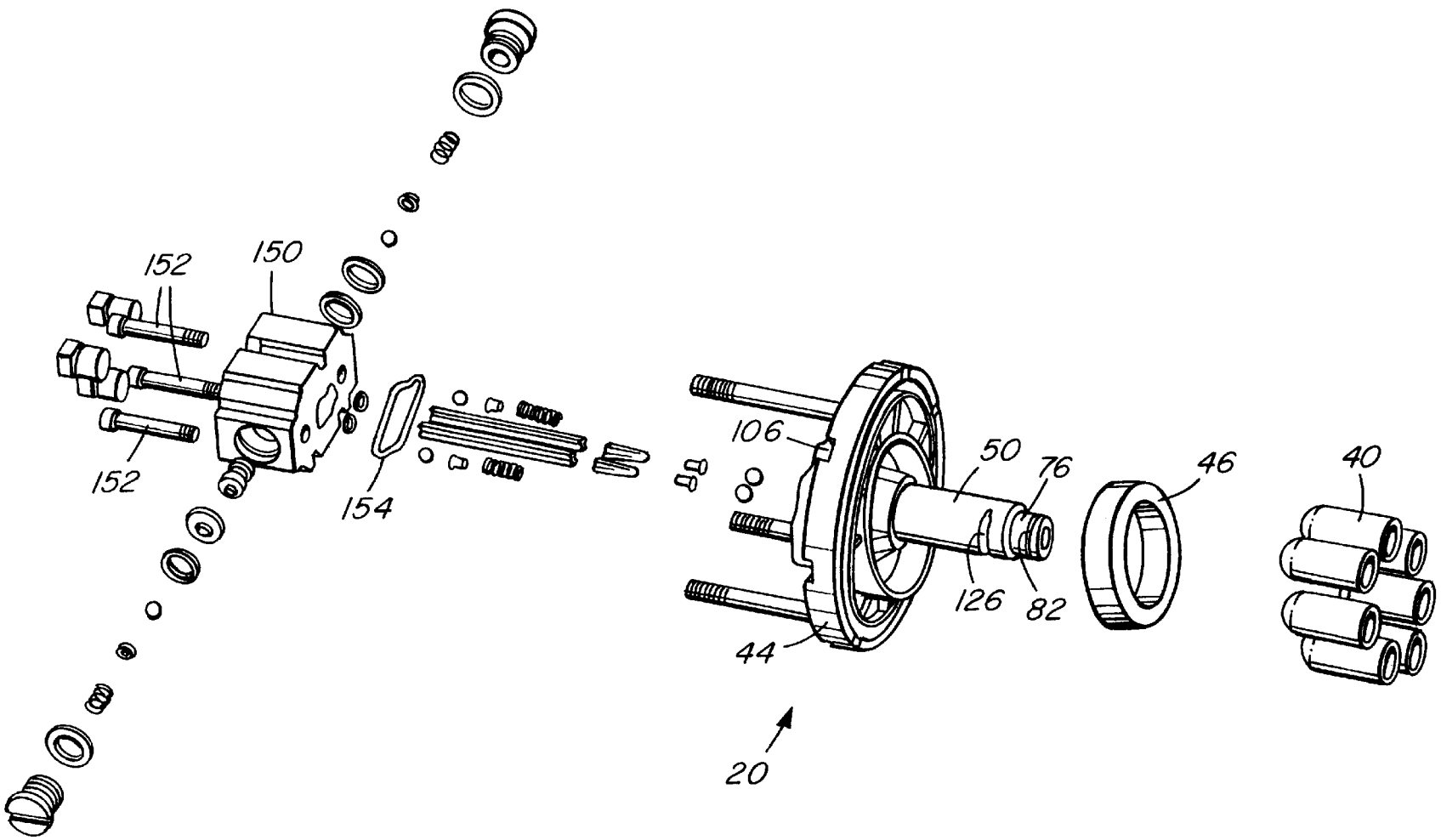
FIG. 2 is an exploded isometric view showing the remainder of the pump shown in FIG. 1 including the pistons, swash plate member and spigot, and the valve connected thereto.

Referring to the drawings, and first to FIG. 1 and FIG. 2, these show a rotary, swash plate pump 20 of the type used for marine steering systems, although the pump could be used for other purposes or adapted for other purposes. The pump includes a drive shaft 22. In marine steering applications, the steering wheel (not shown) is mounted on the shaft. The shaft in this example is fixedly mounted on an end cap 24.

Figure 3:
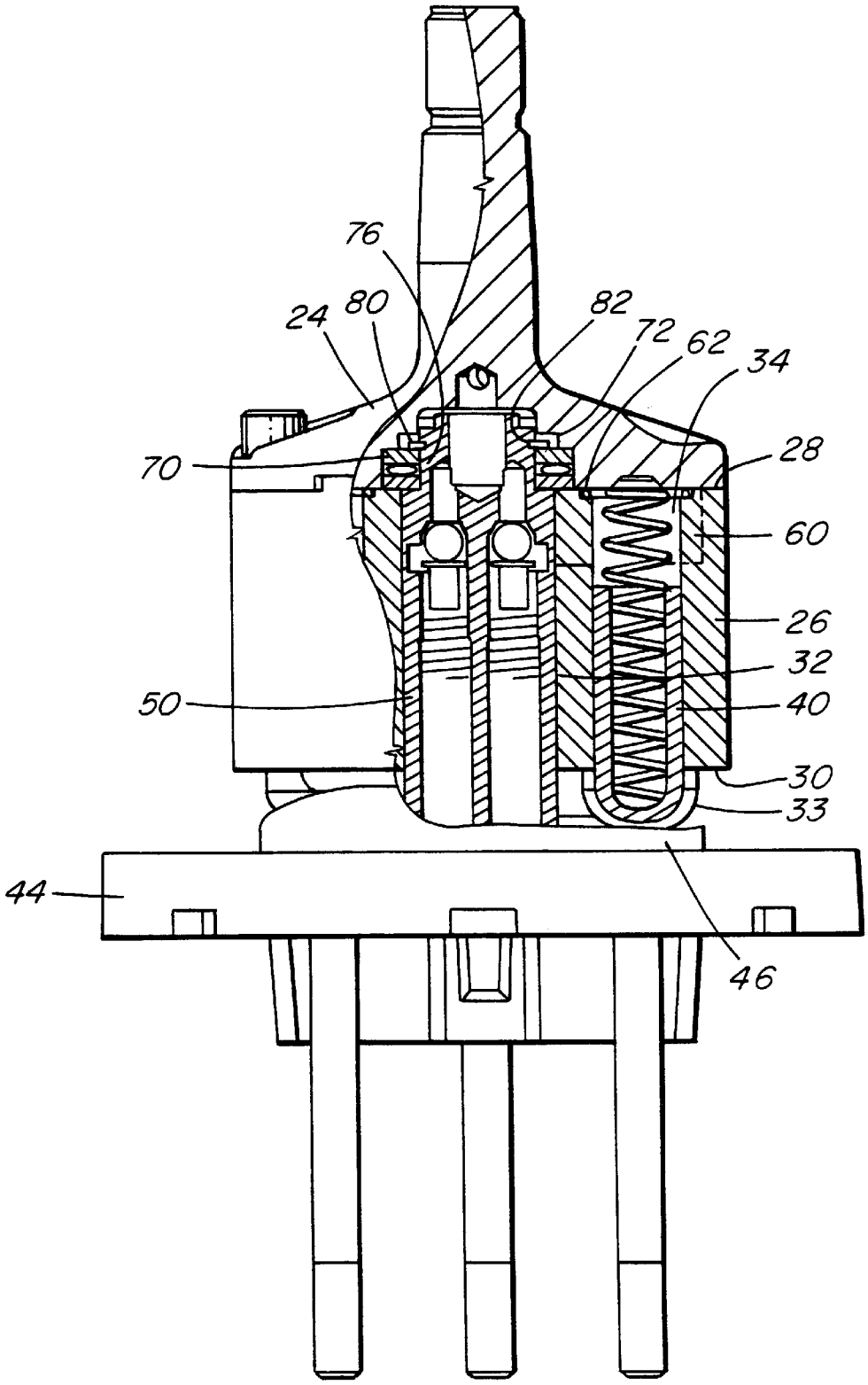
FIG. 3 is a fragmentary, partly sectional view showing a portion of the end cap, a portion of the spigot and the rotor including one of the cylinder bores and one of the pistons.
Figure 7:
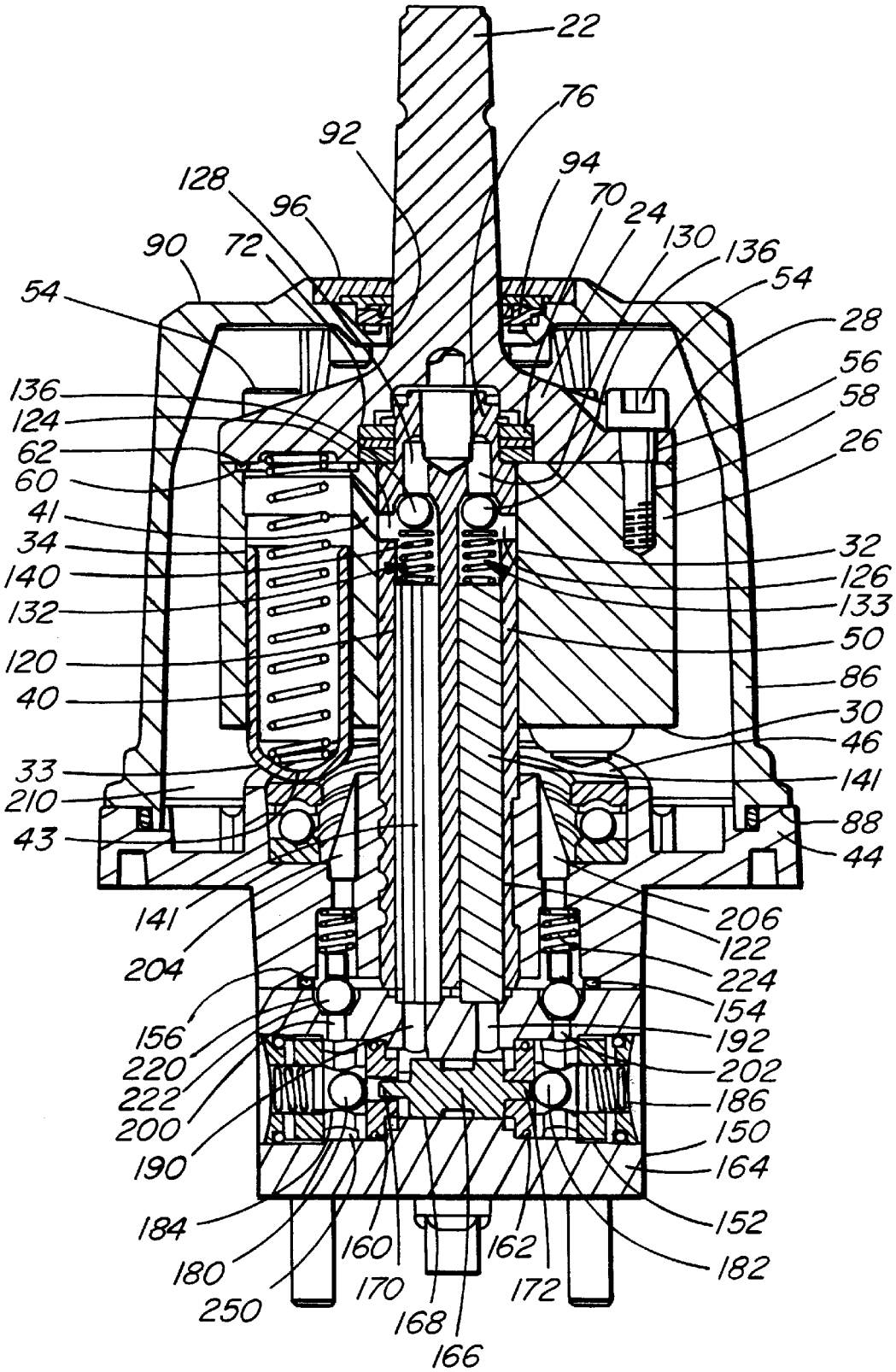
FIG. 7 is a longitudinal section of the pump and valve connected thereto.

The pump includes a rotor 26 which has a first end 28 and a second end 30. There is a central bore 32 and a plurality of cylinder bores 34 which are arranged about the central bore and extend completely through the rotor from the first end 28 to the second end 30 as seen in FIG. 3. There is a plurality of pistons 40, each being reciprocatingly received in one of the cylinder bores as seen in FIGS. 3 and 7. A passageway 41, shown in FIG. 7, extends through the rotor from each cylinder bore 34 to the central bore 32 of the rotor.

There is a swash plate member 44 with a ball thrust bearing 46. A spigot 50 is rigidly connected to the center of the swash plate member and extends outwardly therefrom. The spigot extends through the central bore 32 of the rotor as shown in FIGS. 3 and 7. Each of the pistons has a rounded end 33 with slidingly engages the swash plate.

End cap 24 is connected to the first end 28 of the rotor, by a plurality of Allen-head bolts 54 in this example. The bolts pass through apertures 56 in the end cap and are threadedly received in apertures 58 of the rotor. As may be seen in FIGS. 3 and 7, the end cap 24 closes off the cylinder bores at the first end of the rotor.

Each of the cylinder bores 34 has an annular recess 60 adjacent the first end 28 of the rotor. An O-ring 62 is conceived within each recess and is compressed between the end cap 24 and the rotor 26 to hydraulically seal each cylinder bore between the rotor and the end cap.

There is a bearing, in this case a needle thrust bearing race 70, which is positioned against the end cap 24 as seen in FIGS. 3 and 7. There is an annular recess 72 on the end of the end cap facing the rotor which receives the bearing. Spigot 50 has a narrower projection 76 which extends through the bearing and is rotatably supports the bearing. A cir-clip 80 is received on groove 82 on the end the spigot to secure the bearing, and therefore the router and end cap assembly, to the spigot in proper relationship.

Figure 4:
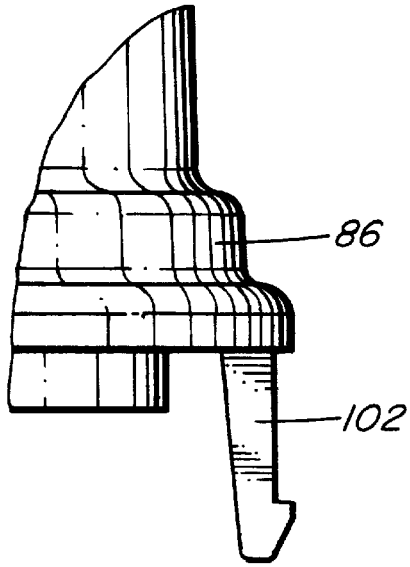
FIG. 4 is a fragmentary elevation of a portion of the cover and one of the tabs thereof.

The pump has a cover 86, shown in FIGS. 1 and 7, which extends about the end cap 24 and the rotor. The cover is a hollow housing with an open end 88 and an opposite end 90 which is closed, apart from central aperture 92. In this example the cover is of glass fiber reinforced polyamide, though other materials could be substituted. The drive shaft 22 extends through the central aperture and is sealed by a seal assembly 94 held in position by a washer 96. The washer is held in place by a plurality of screws 97, shown in FIG. 1, extending through apertures 98 in the washer and apertures 100 in the cover. A plurality of tabs 102 extend outwardly from the cover about the open end 88 as seen in FIG. 1 and FIG. 4.

Figure 8:
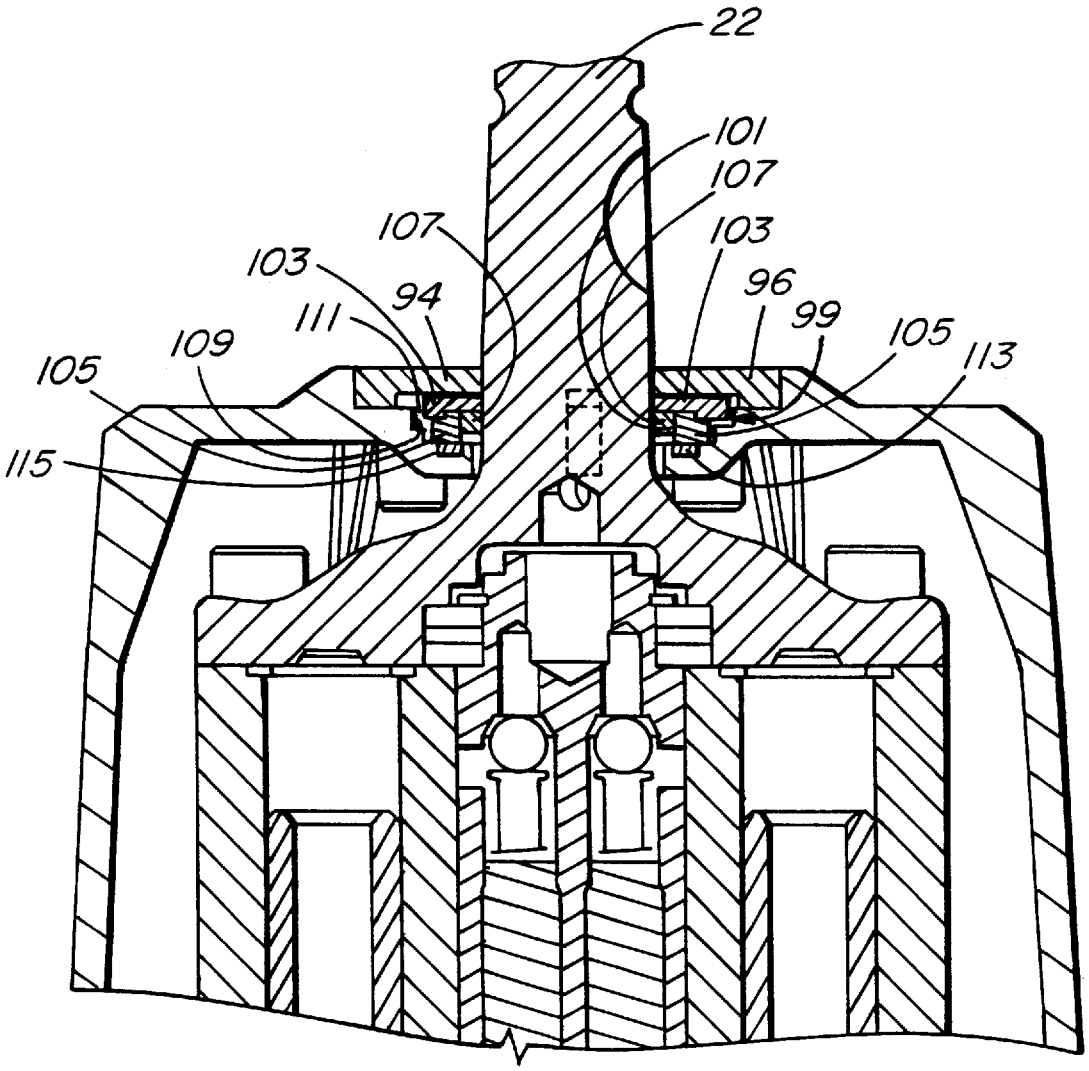
FIG. 8 is an enlarged section of the pump, showing details of the seals between the drive shaft and the cover.

Referring to FIG. 8, the seal assembly 94 is shown in better detail. This includes an annular seal retainer 99 with an inwardly facing, annular channel 101. The retainer in this example is of rigid plastic and is of two components 103 and 105 which are connected together by welding in this embodiment. A resilient, annular seal 107, square in section in this example, is received within the channel 101. The retainer 99 is received within recess 109 on the cover. The recess is larger in diameter than the retainer 99, leaving a gap 111 which permits limited shifting of the seal assembly 94 relative to the cover. An O-ring 113 is received in an annular recess 115 formed in the cover and is compressed between the recess 115 in the cover and the retainer 99. The limited shifting of the seal assembly permitted by the gap 111 means that the drive shaft and the central aperture 92 in the cover do not have to be precisely machined because the retainer can shift relative to the housing so the seal 107 is tightly held against the drive shaft 22 to prevent leakage of fluid outwardly along the drive shaft. Leakage about the retainer 99 is prevented by the O-ring 113.

Figure 5:
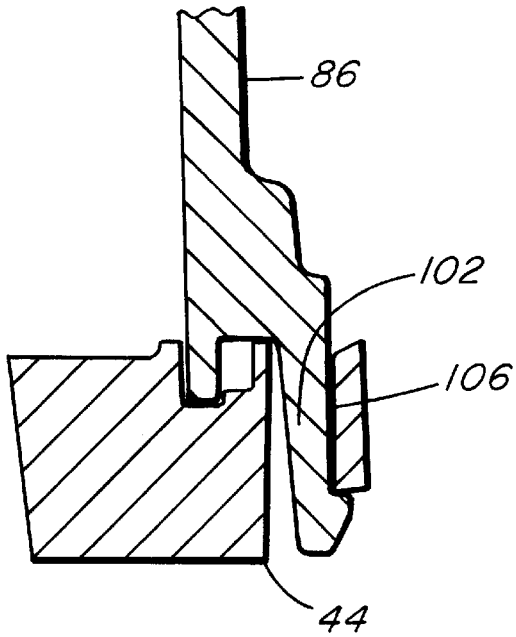
FIG. 5 is a fragmentary sectional view of the swash plate member showing one of the recesses thereof receiving one of the tabs of the cover.
Figure 6:
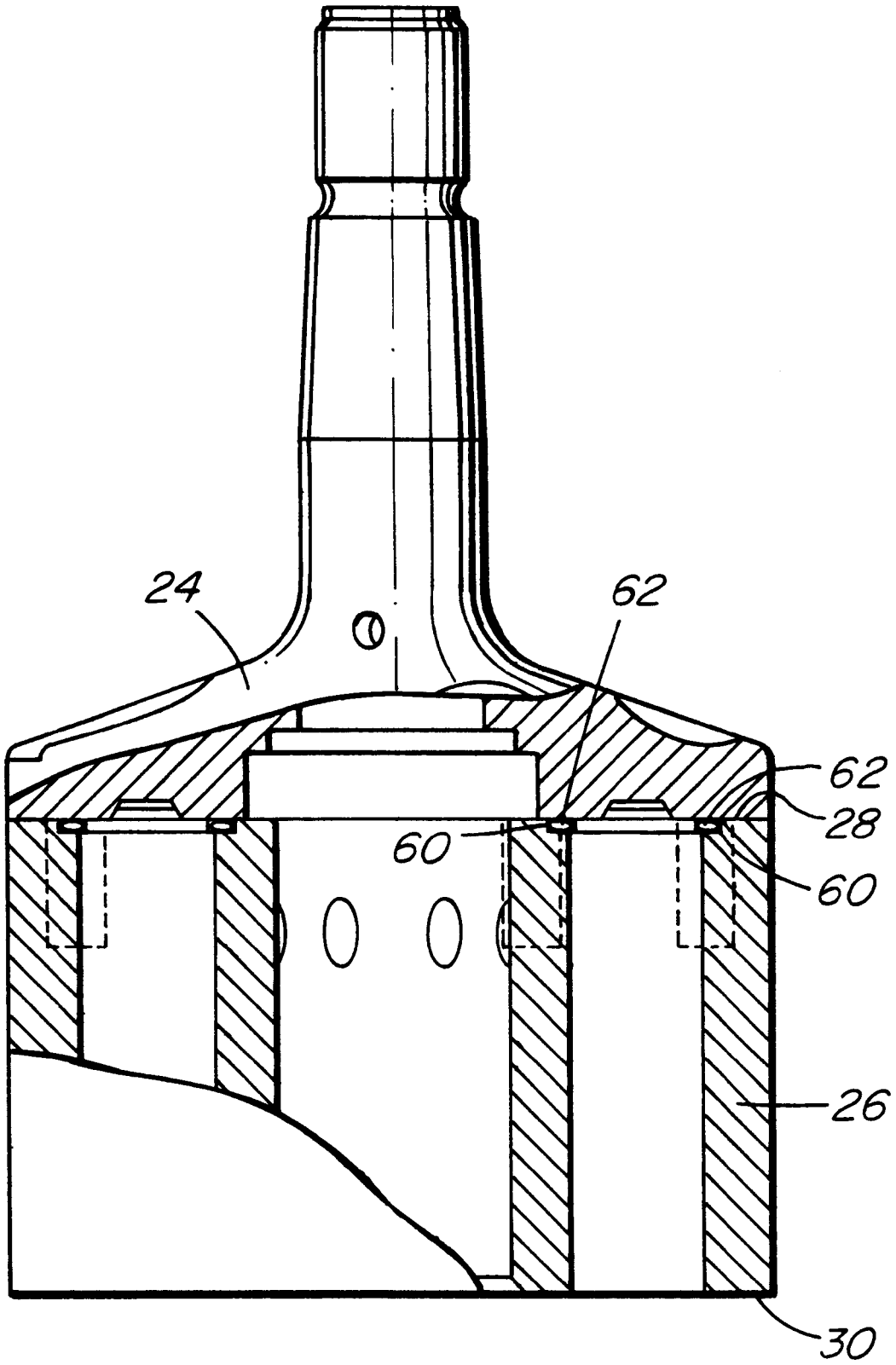
FIG. 6 is a sectional view of the rotor, partly broken away to show two of the cylinder bores of the rotor and the O-rings mounted therein.

Swash plate member 44 has a plurality of recesses 106 at shown in FIG. 2. These correspond in number and position to the tabs 102 on the cover. As shown in FIG. 5, the tabs 102 engage the recesses 106 to secure the cover to the swash plate member. Wedges 108 prevent disengagement of the tabs from the recesses.

It may be seen that the cover 86 is not subject to high hydraulic pressure, nor does it physically take other significant stresses. Its function is chiefly as a protective cover and to prevent leakage of low-pressure hydraulic fluid. Accordingly, in this example, it is made of relatively light-weight plastic only. Other materials could be substituted, for example aluminum, other metals or composites. Also, because the cover is not subject to significant forces, it can be connected to the swash plate member by the tabs 102 which simply snap over the recesses 106. More significant connectors such as bolts are not required. Thus, during assembly of the pump, the cover can simply be snapped in place by pushing it onto the swash plate member, saving in assembly time and cost compared to assemblies requiring bolts or other such fasteners.

Referring to FIG. 7, the spigot 50 has a pair of longitudinal bores 120 and 122 extending therethrough. Slots 124 and 126 extend through the wall of the spigot from bores 120 and 122 respectively. The slots align with the passageways 41 in the rotor, when the cylinder bores 34 are rotated to a position in alignment with the slots, to permit fluid communication between the cylinder bores and the bores 120 and 122 in the spigot. The bores have inner ends 128 and 130 equipped with check valves 132 and 133. Each of the check valves includes a ball 136 biased against a passageway 138 by a spring 140.

A longitudinal member 141 extends through each of the passageways 120 and 122 to support the spring 140. In this example the member is x-shaped in section although it could be tubular or another shape in alternative embodiments.

A lock valve 150 is connected to the swash plate member 44 by a plurality of bolts 152 shown in FIG. 2. A resilient seal 154 is received in recess 156 of the swash plate member as seen in FIG. 7 and is compressed between the swash plate member and the valve by the bolts in this embodiment.

A pair of O-rings 160 and 162 are compressed between the valve and the spigot about the passageways 120 and 122 respectively. The longitudinal members 141 extend from the springs 140 to the valve.

The valve 150 is generally conventional in structure and includes a body 164 with a valve spool 166 reciprocatingly mounted in bore 168 thereof. The valve is generally conventional and similar to the valve disclosed in U.S. Pat. No. 4,669,494 to McBeth and accordingly is described only briefly including the differences between this valve in the valve disclosed in McBeth. The spool has projections 170 and 172 on opposite ends thereof which can engage balls 180 and 182 of check valves 184 and 186, depending upon the position of the spool. Passageways 190 and 192 extend through the body and communicate with the bores 120 and 122 at one end and with the bore 168 as the opposite end.

Figure 9:
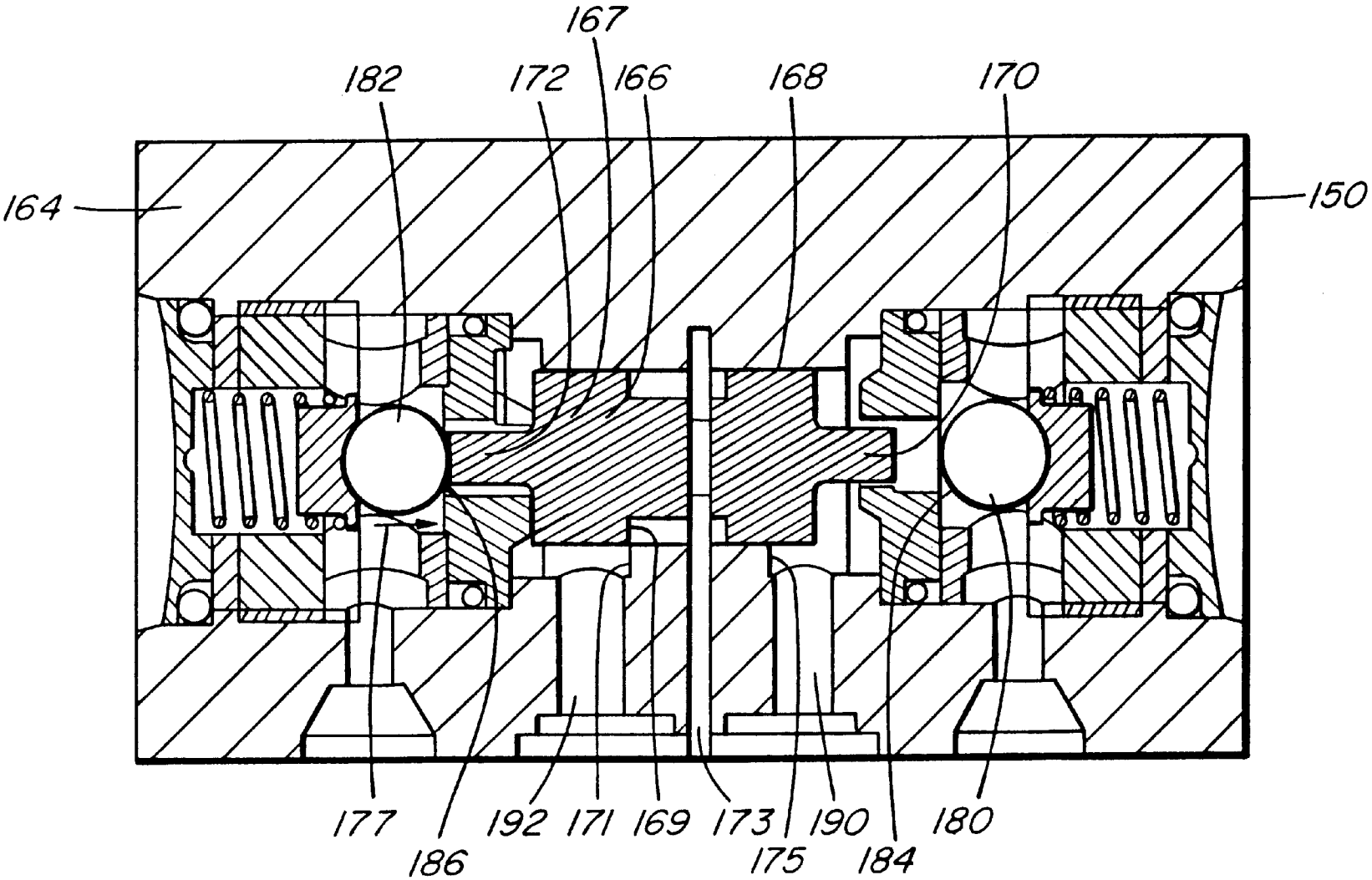
FIG. 9 is an enlarged, sectional view of the lock valve of the pump.

The valve 150 differs from the valve in U.S. Pat. No. 4,669,494 in that it does not require a separate return port to allow fluid to flow to or from the tank passage. The valve body has an edge 171 adjacent the passageway 192 and the bore 168 as seen in FIG. 9. When the edge 169 on land 167 of the spool clears edge 171 of the body, as the spool is shifted to the left from the point of view of FIG. 9, returning fluid, indicated by arrows 177, can enter tank passageway 173. This removed the need for a separate return port for the tank passage and makes the valve easier and less expensive to manufacture. There is a similar edge 175 adjacent passageway 190.

Passageways 200 and 202 extend from the check valves 184 and 186 to the swash plate member 44 where they communicate with passageways 204 and 206 which communicate with space 210 between the cover and the rotor. Each of the passageways 200 and 202 is provided with a check valve 220 which includes a ball 222 biased by a spring 224.

In operation, the drive shaft 22 is rotated by the helm, depending upon the direction the boat is steered. This causes some of the pistons 40, for example piston 40.1 of FIG. 7, to move upwardly, from the point of view of the drawing, as curved end 33 rides on the angled swash plate. The piston moves towards end cap 24 and pumps fluid through the passageway 41 and slot 126 into the longitudinal passageway 120. The pressurized fluid passes through passageway 190 in the valve 150 to communicate with the bore 168. This pressurized fluid unseats the ball 180 and allows the pressurized fluid to exit the valve through port 250 which is connected to the appropriate steering cylinder of the boat. At the same time, the pressurized fluid shifts the spool 166 to unseat ball 182 and allow fluid from the other side of the steering cylinder to return to the cylinder bore 34 shown on the right side in FIG. 7 through passageway 122, slot 126 and passageway 41.

The steering cylinder in some instances may be unbalanced. This occurs when the piston rod extends from its piston through one end of the cylinder only. Thus the effective areas of the piston are different on opposite sides. Therefore the volume of fluid flowing into one side is different from the volume flowing out of the opposite side. The invention is capable of accommodating this difference. If the volume of fluid returning to one of the cylinder bores 34 in the rotor is insufficient, then the appropriate ball 136 opens to admit fluid through passageway 138 from reservoir.

If, on the other hand, the volume of fluid returning is too great, then the spool is shifted further past the edge 171 or 175 to return the excess fluid to reservoir through passageway 173.

Referring to FIG. 7, it may be observed that the invention effectively eliminates leakage of fluid which has occurred with prior art devices. Even though the cover 86 may be made of plastic, all of the high-pressure fluid from the pump may be confined within metallic parts including rotor 26, the spigot and the valve 150. The rotor in this example is of metal as are the pistons 34 so the fluid above the pistons is confined by the metal components. The fluid extends through the passageways 41 into the spigot which is also of metal. Within the spigot the fluid is confined within the bores 120 and 122. The outer end of the spigot is sealed against the body 164 of the valve which is also of metal. The high-pressure fluid within the valve is accordingly confined within metal components.

Low-pressure fluid is confined within the system. It is located in the space 210 between the cover 84 and the rotor, within the passageways 128 and 130 as well as the cavities above and about the ball race 70, within the passageways 204 and 206 as well as the space between the swash plate and the spigot and the check valves below, between the pistons and the rotor and between the spigot and the rotor and swash plate member. Seal 154 prevents any leakage where the valve body is connected to the swash plate member. The only potential path for fluid to leak out of the pump, once the valve is attached, is along the drive shaft 22 about aperture 92. However this leakage is prevented by seal 99. This assumes a tight connection at port 250 together with the corresponding port on the other side of the valve. Unlike some prior art pumps of the type, there is no ready path for fluid to leak from the pump, for example between the spigot and the swash plate member.

It will be understood by someone skilled in the art that many of the details described above are by way of example only and are not intended to limit the scope of the invention which is to be interpreted with reference to the following claims.

What is claimed is:

1. A rotary pump, comprising:

a rotor having a first end, a second end opposite the first end, a central bore and a plurality of cylinder bores arranged about the central bore and extending completely through the rotor from the first end to the second end;

a plurality of pistons, each said piston being reciprocatingly received in one of the cylinder bores;

a swash plate member having a swash plate adjacent to the second end of the rotor;

a spigot extending through the swash plate member and the central bore of the rotor, the rotor being rotatably supported on the spigot;

an end cap connected to the first end of the rotor, the end cap closing off the cylinder bores at the first end of the rotor;

a seal about each of the cylinder bores between the rotor and the end cap;

a drive shaft rigidly connected to the end cap and extending away from the rotor; and a cover having an aperture rotatably receiving the drive shaft, the cover extending about the end cap and the rotor and being connected to the swash plate member.

2. The rotary pump as claimed in claim 1, including a bearing positioned between the spigot and the rotor.

3. The rotary pump as claimed in claim 2, including a retainer for securing the bearing to the spigot.

4. The rotary pump as claimed in claim 3, wherein the bearing is a ball race and the retainer is a cir-clip.

5. The rotary pump as claimed in claim 1, wherein the cover has a plurality of spaced-apart tabs and the swash plate has a plurality of spaced-apart recesses, the tabs engaging the recesses to connect the cover to the swash plate member.

6. The rotary pump as claimed in claim 1, wherein each of the seals is an O-ring.

7. A rotary pump, comprising:

a rotor having a first end, a second end opposite the first end, a central bore and a plurality of cylinder bores arranged about the central bore and extending completely through the rotor from the first end to the second end;

a plurality of pistons, each said piston being reciprocatingly received in one of the cylinder bores;

a swash plate member having a swash plate adjacent to the second end of the rotor;

a spigot extending through the swash plate member and the central bore of the rotor, the rotor being rotatably supported on the spigot;

an end cap releasibly connected to the first end of the rotor, the end cap closing off the cylinder bores at the first end of the rotor;

a drive shaft rigidly connected to the end cap and extending away from the rotor; and a cover having an aperture rotatably receiving the drive shaft, the cover extending about the end cap and the rotor and being connected to the swash plate member.

8. The rotary pump as claimed in claim 7, including a lock valve connected to the swash plate member on a side thereof opposite the cover, the lock valve having a lock body, the spigot extending through the swash plate member and sealingly engaging the valve body.

9. The rotary pump as claimed in claim 8, wherein the spigot has two longitudinal passageways and openings extending outwardly adjacent to the rotor, the rotor having a passageway extending from each said cylinder bore thereof to the spigot, the passageways of the rotor being aligned with the openings in the spigot, whereby fluid passes between the longitudinal passageways in the spigot and the cylinder bores.

10. The rotary pump as claimed in claim 9, wherein the spigot, the rotor, the pistons and the valve body are of metal, whereby high-pressure fluid pumped by the pistons is confined in metal parts.

11. The rotary pump as claimed in claim 10, wherein the cover is of plastic.

12. The rotary pump as claimed in claim 9, wherein the valve has a bore extending therethrough, two valve passageways extending therethrough and communicating with the bore, each said valve passageway communicating with one of the passageways in the spigot, the valve body having an edge adjacent each said valve passageway along the bore, and a tank passageway, the tank passageway communicating with said each valve passageway when a land of the spool is shifted past the edge.

13. The rotary pump as claimed in claim 7, including a seal member extending about the drive shaft between the drive shaft and the cover.

14. The rotary pump as claimed in claim 13, wherein the seal member includes a resilient seal held by a rigid retainer, the cover having a recess which loosely receives the retainer, permitting limited movement of the seal member relative to the cover.

15. The rotary pump as claimed in claim 14, wherein the seal member has an inwardly facing channel which receives the seal.

16. The rotary pump as claimed in claim 15, including a resilient seal between the seal member and the cover.

17. A rotary pump, comprising:

a rotor having a first end, a second end opposite the first end, a central bore and a plurality of cylinder bores arranged about the central bore and extending completely through the rotor from the first end to the second end;

a plurality of pistons, each said piston being reciprocatingly received in one of the cylinder bores;

a swash plate member having a swash plate adjacent to the second end of the rotor;

a spigot extending through the swash plate member and the central bore of the rotor, the rotor being rotatably supported on the spigot;

an end cap connected to the first end of the rotor by fasteners, the fasteners being bolts, the end cap closing off the cylinder bores at the first end of the rotor;

a drive shaft rigidly connected to the end cap and extending away from the rotor; and a cover having an aperture rotatably receiving the drive shaft, the cover extending about the end cap and the rotor and being connected to the swash plate member.

18. A rotary pump, comprising:

a rotor having a first end, a second end opposite the first end, a central bore and a plurality of cylinder bores arranged about the central bore and extending completely through the rotor from the first end to the second end;

a plurality of pistons, each said piston being reciprocatingly received in one of the cylinder bores;

a swash plate member having a swash plate adjacent to the second end of the rotor;

an end cap connected to the first end of the rotor, the end cap closing off the cylinder bores at the first end of the rotor;

a spigot extending through the central bore of the rotor and terminating in the end cap, the rotor and the end cap being rotatable on the spigot; and a drive shaft drivingly connected to the end cap and extending away from the rotor.

19. A rotary pump as claimed in claim 18, wherein said spigot extends through said swash plate member.

20. A rotary pump as claimed in claim 18, wherein said drive shaft is rigidly connected to said end cap.

21. A rotary pump as claimed in claim 20, wherein the end cap is connected to the rotor by fasteners.

22. A rotary pump as claimed in claim 21, wherein the fasteners are bolts.

23. A rotary pump as claimed in claim 18, and further comprising a cover having an aperture rotatably receiving the drive shaft, the cover extending about the end cap and the rotor and being connected to the swash plate member.

24. A rotary pump as claimed in claim 23, wherein the cover has a plurality of spaced-apart tabs and the swash plate member has a plurality of spaced-apart recesses, the tabs engaging the recesses to connect the cover to the swash plate member.

25. A rotary pump as claimed in claim 23, including a lock valve connected to the swash plate member on a side thereof opposite the cover, the lock valve having a body, the spigot extending through the swash plate member and sealingly engaging the body.

26. A rotary pump as claimed in claim 25, wherein the spigot has two longitudinal passageways and openings extending outwardly adjacent to the rotor, the rotor having a passageway extending from each said cylinder bore thereof to the spigot, the passageways of the rotor being aligned with the openings in the spigot, whereby fluid passes between the longitudinal passageways in the spigot and the cylinder bores.

27. A rotary pump as claimed in claim 26, wherein the valve has a bore extending therethrough, two valve passageways extending therethrough and communicating with that bore, each said valve passageway communicating with one of the passageways in the spigot, the valve body having an edge adjacent each said valve passageway along that bore, and a tank passageway, the tank passageway communicating with each said valve passageway when a land of a spool of the valve is shifted past the edge.

28. A rotary pump as claimed in claim 25, wherein the spigot, the rotor, the pistons and the valve body are of metal, whereby high-pressure fluid pumped by the pistons is confined in metal parts.

29. A rotary pump as claimed in claim 28, wherein the cover is of plastics.

30. A rotary pump as claimed in claim 23, including a seal member extending about the drive shaft between the drive shaft and the cover.

31. A rotary pump as claimed in claim 30, wherein the seal member includes a resilient seal held by a retainer, the cover having a recess which loosely receives the retainer, permitting limited movement of the seal member relative to the cover.

32. A rotary pump as claimed in claim 31, wherein the retainer has an inwardly facing channel which receives the seal.

33. A rotary pump as claimed in claim 31, including a resilient seal between the seal member and the cover.

34. A rotary pump as claimed in claim 18, including a bearing effective between the spigot and the rotor.

35. A rotary pump as claimed in claim 34, including a retainer for securing the bearing to the spigot.

36. A rotary pump as claimed in claim 35, wherein the bearing is a thrust bearing and the retainer is a clip.

37. A rotary pump as claimed in claim 18, including a seal about each of the cylinder bores and between the rotor and the end cap.

38. A rotary pump as claimed in claim 37, wherein each of the seals is an O-ring.

39. A rotary pump as claimed in claim 18, wherein the end cap is releasably connected to the rotor.

40. A rotary pump, comprising:

a rotor having a first end, a second end opposite the first end, a plurality of cylinder bores arranged about and formed in the rotor;

a plurality of pistons, each said piston being reciprocatingly received in one of the cylinder bores;

a swash plate member having a swash plate adjacent to the second end of the rotor;

a drive shaft drivingly connected to the rotor and extending away from the swash plate member;

the rotor and the piston bounding high-pressure driving volume of the pump; and a cover having an aperture rotatably receiving the drive shaft, the cover extending about the rotor and being connected to the swash plate member and bounding only low-pressure volume of the pump.

41. A rotary pump, comprising:

a rotor having a first end, a second end opposite the first end, a plurality of cylinder bores arranged about and formed in the rotor;

a plurality of pistons, each said piston being reciprocatingly received in one of the cylinder bores;

a swash plate member having a swash plate adjacent to the second end of the rotor;

a drive shaft drivingly connected to the rotor and extending away from the swash plate member;

a cover having an aperture rotatably receiving the drive shaft, the cover extending about the rotor and being connected to the swash plate member;

a seal member extending about the drive shaft between the drive shaft and the cover; and the cover having a recess which loosely receives the seal member, permitting limited movement of the seal member relative to the cover.

42. A rotary pump, comprising:

a rotor having a first end, a second end opposite the first end, a central bore and a plurality of cylinder bores arranged about the central bore and formed in the rotor;

a plurality of pistons, each said piston being reciprocatingly received in one of the cylinder bores;

a swash plate member having a swash plate adjacent to the second end of the rotor;

a spigot extending through the central bore of the rotor, the rotor being rotatable on the spigot, a drive shaft drivingly connected to the rotor and extending away from the swash plate member;

a lock valve connected to the swash plate member on a side thereof opposite the rotor, the lock valve having a body, the spigot extending in the swash plate member and sealingly engaging the body;

the spigot having two longitudinal passageways and openings extending outwardly adjacent to the rotor, the rotor having a passageway extending from each said cylinder bore thereof to the spigot, the passageways of the rotor being aligned with the openings on the spigot, whereby fluid passes between the longitudinal passageways in the spigot and the cylinder bores;

the valve having a spool with a land and a bore extending therethrough, two valve passageways extending therethrough and communicating with that bore, each said valve passageway communicating with one of the passageways in the spigot, the valve body having an edge adjacent each said valve passageway along that bore, and a tank passageway, the tank passageway communicating with each said valve passageway when the land of the spool of the valve is shifted past the edge.

* * * * *